United States Patent [19]

Slee

[11] Patent Number: 4,841,927

[45] Date of Patent: Jun. 27, 1989

[54] CERAMIC CYLINDERS

[75] Inventor: Roger H. Slee, Warwick, England

[73] Assignee: AE PLC, Rugby, England

[21] Appl. No.: 154,306

[22] Filed: Feb. 10, 1988

[30] Foreign Application Priority Data

Feb. 13, 1987 [GB] United Kingdom ..... 8703330

[51] Int. Cl.[4] ..... F01F 1/18

[52] U.S. Cl. ..... 123/193 C; 123/668

[58] Field of Search ..... 123/193 C, 668, 669, 123/41.84

[56] References Cited

U.S. PATENT DOCUMENTS 4,419,971 12/1983 Nakamura et al. ..... 123/193 C

*Primary Examiner*—E. Rollins Cross

*Attorney, Agent, or Firm*—William R. Hinds

[57] ABSTRACT

Ceramic cylinder assemblies for internal combustion engines, particularly diesels, are described. The assemblies comprise at least two portions including at least one main cylinder portion and at least one combustion region portion, the at least two portions being contained within a metal sleeve and wherein the at least one combustion region portion has a generally axially directed slit therein, the slit passing through the whole thickness of the ceramic material.

5 Claims, 2 Drawing Sheets

CERAMIC CYLINDERS

The present invention relates to cylinders for internal combustion engines and particularly to such cylinders manufactured from ceramic materials. It is desirable to be able to manufacture some components of internal combustion engines, especially diesels, from ceramic material. Such components include the pistons and cylinders or cylinder liners which may be subject to the action of hot combustion gases and abrasive fuels. It is generally considered that the ability to use ceramic materials for some components will allow higher temperatures to be employed in the combustion chamber region, such higher temperatures being advantageous in lowering noxious emissions from the engine. Another advantage of some ceramic materials is the ability to operate without the need for external lubrication at high temperatures.

The cylinder of an internal combustion engine has to withstand high mechanical stresses due to the gas pressures generated by the burning fuel charge at the moment of ignition and also very high thermal stresses due to temperature fluctuations over short time periods. Not only are such stresses continuously varying with time in the region of the cylinder near to the combustion chamber but they are also varying depending on position in all other parts of the cylinder. There is, for example, a stress gradient due to gas pressure variations throughout the working cycle and also a thermal stress gradient due to temperature variation from top to bottom of the cylinder. Such stress variations especially when combined with physical discontinuities in ceramic cylinder components can lead to catastrophic failures. For example, in the case of a diesel engine having horizontally opposed pistons where a fuel injector port is sited in the centre of the axial length of the cylinder, it has been found that failure of the cylinder occurs by cracks emanating from the fuel injector port which acts as a stress concentrator.

Ceramic materials are generally better at withstanding compressive stresses than tensile stresses. In order to minimize the tensile stresses imposed upon the ceramic material of the cylinder it has been proposed to fit the complete ceramic cylinder inside a metal supporting sleeve by interference or shrink fitting. A problem with this is that due to the thermal and mechanical stresses involved and to differences in the coefficient of thermal expansion between the metal sleeve and the ceramic piece the ceramic liner invariably works loose. According to the present invention a ceramic cylinder for an internal combustion engine comprises at least two portions including at least one main cylinder portion and at least one combustion region portion, the at least two portions being contained within a metal housing and wherein the at least one combustion region portion has a generally axially directed slit therein, the slit passing through the whole thickness of the ceramic material. The portion of liner in the combustion region has to withstand the highest thermal and mechanical stresses. The slit allows this portion to deform elastically in compression and to accommodate any expansion effects in the supporting metal housing without loosening. The metal housing may comprise a metal sleeve.

Where necessitated by the specific engine design, features such as injection ports etc. may be sited on the line of the slit thereby minimizing any stress raising tendencies such features may otherwise promote.

Stresses due to gas pressure within the cylinder are borne in compression since the combustion chamber portion of the cylinder liner is able to be fully supported by the metal housing without the generation of significant tensile stresses.

In order that the invention may be more fully understood examples will now be described by way of illustration only with reference to the accompanying drawings, of which:

Figure 1:
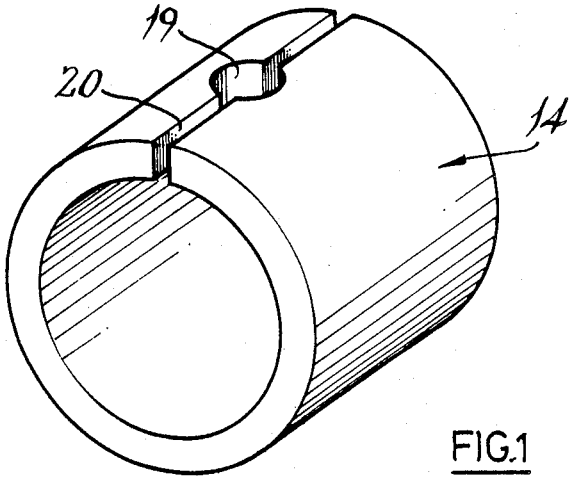
FIG. 1 shows a schematic perspective view of a combustion chamber region portion of a ceramic cylinder liner according to the present invention for an opposed-piston 2-stroke diesel engine.
Figure 2:
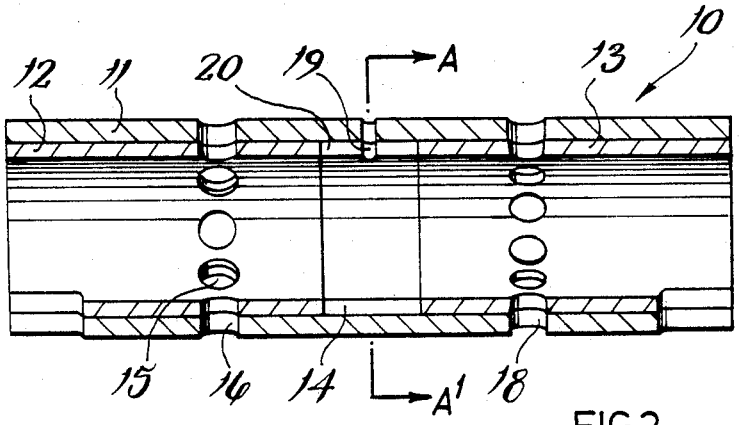
FIG. 2 shows a section in elevation of a ceramic cylinder liner assembly according to the present invention.
Figure 3:
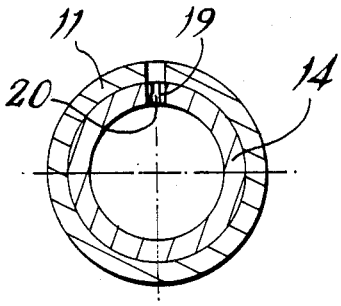
FIG. 3 shows a section through the line $AA^1$ of the cylinder liner of FIG. 2 looking in the direction of the arrows.

Referring now to FIGS. 1 to 3 and where the same features are denoted by common reference numerals. A complete cylinder liner assembly is denoted at 10. The assembly comprises a steel outer sleeve 11, two outer main cylinder portions 12, 13 and a combustion region portion 14. One outer portion 12 includes exhaust ports 15 which pass through co-operating ports 16 in the sleeve 11 whilst the other outer portion 13 includes inlet ports which similarly co-operate with ports 18 in the sleeve 11. The combustion region portion 14 includes a fuel injection port 19 which is situated in an axial slit 20 which passes through the wall thickness of the portion 14. The portions 12, 13 and 14 are made from silicon nitride material produced by the reaction bonding process. Other materials may of course be used including, for example, sintered silicon nitride, Syalon (trade mark), silicon carbide, etc.

The portion 14 is compressed such that the opposite faces of the slit 20 approach each other and is permanently elastically deformed whilst in the sleeve 11 even allowing for temperature effects. Siting of the injection port 19 in the slit 20 prevents the port from becoming a significant stress-raising feature. Because the portion 14 is permanently in compression harmful tensile forces are never able to develop whatever the temperature and gas loading conditions. The ceramic liner portions are assembled into the sleeve 11 and any steps present at the interfaces between the portions are removed by a grinding operation which results in the cylinder achieving the desired finished bore dimension. Any slight step which may be generated during running may be accommodated by appropriate tapers or chamfers on the associated pistons (not shown) and piston rings (not shown) if used. To allow for inevitable variations in differential expansion between the steel sleeve and ceramic cylinder portions, heat degradable spacers may be positioned between the cylinder portions. Plastics materials such as acrylic plastic, for example, may be used. Such shims or spacers burn away in operation to leave the desired axial spacing of the ceramic cylinder portions. The ash produced is ejected via the exhaust ports.

Figure 4:
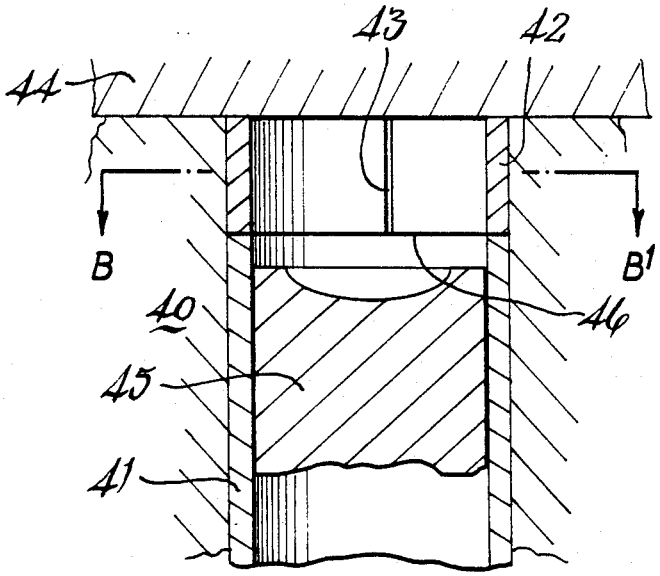
FIG. 4 shows a section in elevation of a schematic representation of another type of reciprocating piston diesel engine having a cylinder according to the present invention.
Figure 5:
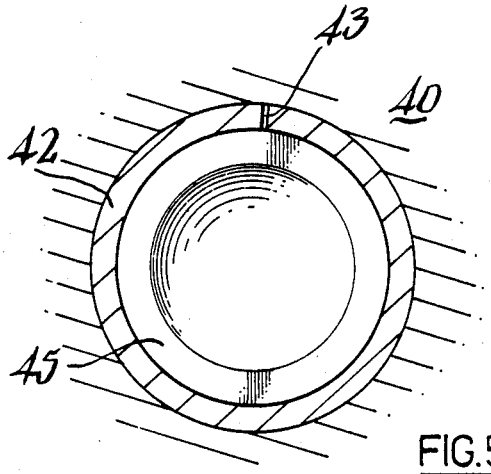
FIG. 5 shows a section through the line $BB^1$ of FIG. 4 looking in the direction of the arrows.

The portion 14 may be of relatively short axial length since the rate of gas pressure and temperature reduction along the cylinder axial length is very high. The portions 12 and 13 are fully able to accommodate the gas pressure and temperature variations without the need for an axial slit since the average levels of pressure and temperature are much lower. Furthermore, there is no extra gas leakage due to the slit since the effect of the slit is only to add a slight additional volume to the combustion chamber, the slit being effectively sealed at the interfaces between the three portions. FIGS. 4 and 5 show a cylinder in an engine the cylinder comprising a cast iron support 40 formed by the engine block, a main cylinder portion 41 and a combustion region portion 42. The combustion region portion 41 comprises a slit 43 in the axial direction. Fuel injection means (not shown) are included in the cylinder head 44. A piston 45 traverses the joint interface 46 between the two portions 41 and 42.

I claim:

1. A ceramic cylinder for an internal combustion engine said cylinder comprising at least two portions including at least one main cylinder portion and at least one combustion region portion, said at least two portions being contained within a metal housing, wherein said at least one combustion region portion has a generally axially directed slit therein, said slit passing through the whole thickness of the ceramic material.

2. A cylinder according to claim 1 further having features such as injection ports sited on the line of said slit.

3. A cylinder according to claim 1 wherein said ceramic material comprises silicon nitride.

4. A cylinder according to claim 1 wherein said housing comprises a metal sleeve.

5. A cylinder according to claim 4 wherein said sleeve is made of steel.

* * * * *